US007797967B2

(12) United States Patent
Shirasaki et al.

(10) Patent No.: US 7,797,967 B2
(45) Date of Patent: Sep. 21, 2010

(54) WARP KNITTING FABRIC AND ITS MANUFACTURING METHOD

(75) Inventors: Fumio Shirasaki, Fukui (JP); Koichi Oida, Fukui (JP)

(73) Assignee: Seiren Co., Ltd., Fukui (JP)

( * ) Notice: Subject to any disclaimer, the term of this patent is extended or adjusted under 35 U.S.C. 154(b) by 359 days.

(21) Appl. No.: 11/887,519

(22) PCT Filed: Mar. 31, 2006

(86) PCT No.: PCT/JP2006/306947

§ 371 (c)(1),
(2), (4) Date: Nov. 6, 2007

(87) PCT Pub. No.: WO2006/106975

PCT Pub. Date: Oct. 12, 2006

(65) Prior Publication Data

US 2009/0064721 A1 Mar. 12, 2009

(30) Foreign Application Priority Data

Mar. 31, 2005 (JP) ..... 2005-104861

(51) Int. Cl.
*D04B 21/00* (2006.01)

(52) U.S. Cl. ..... 66/195

(58) Field of Classification Search ..... 66/195, 66/192, 177, 176, 203, 87
See application file for complete search history.

(56) References Cited

U.S. PATENT DOCUMENTS 3,629,871 A * 12/1971 Sarmiento ..... 2/407
3,656,323 A * 4/1972 Brown ..... 66/177
3,656,324 A * 4/1972 Jackson ..... 66/177
3,685,319 A * 8/1972 Jackson ..... 66/87
3,703,820 A * 11/1972 Jackson ..... 66/177
3,739,398 A * 6/1973 Sarmiento ..... 2/407
4,920,769 A * 5/1990 Rickerl ..... 66/176
5,491,846 A * 2/1996 Muller ..... 2/400
6,192,717 B1 * 2/2001 Rabinowicz ..... 66/177
6,212,913 B1 * 4/2001 Weiss ..... 66/172 R
6,389,850 B1 5/2002 Fujiwara
6,401,498 B1 * 6/2002 Fujiwara ..... 66/195
6,453,705 B2 * 9/2002 Fujiwara ..... 66/176
6,823,700 B1 * 11/2004 Yi ..... 66/192
7,347,245 B2 * 3/2008 Graichen ..... 160/89

FOREIGN PATENT DOCUMENTS

JP 52-12306 4/1977
JP 57-71460 5/1982

(Continued)

*Primary Examiner*—Danny Worrell
(74) *Attorney, Agent, or Firm*—Jordan and Hamburg LLP

(57) ABSTRACT

A warp knitting fabric, excellent in a dimension stability and a shape stability or the like and preferably used for underpants or panty, or a shirt or the like, including: tube-shaped fabric parts that form articles in a predetermined pattern; marginal fabric portions that are knitted simultaneously with said fabric parts, and to be eventually cut therefrom; and bridging portions formed by knitting at a predetermined interval in wale direction, each of which connects a fringe of said fabric part onto the marginal fabric portion contiguous to the fringe; and wherein the bridging portions are formed by knitting to have a dimension of 2-20 courses in the wale direction, at an interval of 2-50 courses.

6 Claims, 9 Drawing Sheets

FOREIGN PATENT DOCUMENTS

| | | |
|---|---|---|
| JP | 62-104901 | 5/1987 |
| JP | 62-223351 | 10/1987 |
| JP | 2001-115358 | 4/2001 |
| JP | 3-480917 | 6/2001 |
| JP | 2001-164448 | 6/2001 |
| JP | 2004-91971 | 3/2004 |

* cited by examiner

Knitting pattern for the ground fabric parts

F Front knitting needle

B Rear knitting needle

Knitting pattern for bridging portion of the fabric

F Front knitting needle

B Rear knitting needle

WARP KNITTING FABRIC AND ITS MANUFACTURING METHOD

BACKGROUND OF THE INVENTION

The present invention relates to a warp knitting fabric and its manufacturing method, particularly relates to such fabric and method that achieve stabilization in processing of the knitted fabric and excellent dimension stability and shape stability.

In recent years, a number of seamless clothing articles using a warp knitting fabric have been known. By such a manner, production processes are simplified from prior complicated processes of: knitting various parts of a clothing article such as a trunk part and sleeve parts; and thereafter, cutting the respective parts from the fabric and joining them by sewing to complete the clothing article. Moreover, loss or wasting of fabric due to cutting out or the like is decreased. Thus, manufacturing cost is considerably decreased.

For example, Japan's Issued Patent 3480917 (Patent Document 1) discloses a warp knitting fabric formed by following; a tube-shaped knitting fabric is continuously knitted by warp knitting; and at a part within each unit of constant length, slender-width warp knitted fabric portions are formed on right-hand and left-hand sides, which are to be ultimately cut out and discarded. Such warp knitting fabric, especially ones formed of synthetic fibers having a heat contraction property, such as polyester, nylon or the like, requires heat setting for improving shape and dimension stability in manufacturing and treating the knitted articles.

Patent Document 1: Japan's Issued Patent 3480917

SUMMARY OF THE INVENTION

Such warp knitting fabric having separated portions that are not connected to other part, as described in the Japan's Issued Patent 3480917, has free fringes of fabric parts at right-hand and left-hand sides of the separated portions. Thus, there is caused a fear that, when heated for a heat setting or the like, such fabric parts contracted and deformed so that a desired size and shape is not achieved.

It is thus aimed to solve the above problems and to provide a warp knitting fabric and its fabricating method achieving excellent stability in shape and dimension.

For this end, according to the invention:

(1) a warp knitting fabric is comprised of; fabric parts that form articles in a predetermined pattern; marginal fabric portions that are knitted simultaneously with said fabric parts, and to be eventually cut therefrom; and bridging portions formed by knitting at predetermined intervals in wale direction, each of which connects a fringe of said fabric part onto the marginal fabric portion contiguous to the fringe; and wherein the bridging portions are formed by knitting to have a dimension in a range of 2 through 20 courses in the wale direction, at an interval of 2 through 50 courses.

(2) the warp knitting fabric is constructed as recited in (1), wherein said fabric parts are formed by knitting to be continuous in the wale direction.

(3) the warp knitting fabric is constructed as recited in (2), wherein a plurality of long fabrics extending in wale direction, in each of which the patterns of said fabric parts are formed to be continuous in the wale direction, are knitted together, in a side-by-side arrangement in a course direction.

(4) the warp knitting fabric is constructed as recited in any one of (1) through (3), being tube-shaped.

(5) a manufacturing method of a warp knitting fabric is comprised of; knitting of fabric parts that form articles in a predetermined pattern; knitting of marginal fabric portions that are eventually cut from said fabric parts, simultaneously with knitting of said fabric parts; and knitting of bridging portions at a predetermined interval in wale direction, each of which connects a fringe of said fabric part and adjacent one of the marginal fabric portions; and wherein the bridging portions are formed by knitting to have a dimension in a range of 2 through 20 courses in the wale direction, at an interval in a range of 2 through 50 courses.

(6) the manufacturing method of a warp knitting fabric is constructed as recited in (6), wherein knitting of the bridging portions is made in a manner that; only a portion of number of yarns of said fabric part are passed between a fringe of said fabric part and a fringe of said marginal fabric portions.

There is provided a warp knitting fabric having no concern of contraction or deformation at a time of heat setting or the like so as to provide knitted articles that are excellent in a shape stability and a dimension stability, excellent in a wearing feeling, and excellent in yield.

DETAILED DESCRIPTION OF THE INVENTION

The invention will be explained in reference to the drawings as follows.

Firstly, FIG. 12 shows a conventional technique, by which fabric parts in a shape of underpants or panty are successively formed by warp knitting. At a portion within each fabric unit having a predetermined length, a waste portion 13 that is to be ultimately separated from the article is formed. And, the waste portions 13 is formed by knitting in a manner that right-hand and left-hand fringes of the waste portions are split away from the tube-shaped leg portions 14 of the fabric part 11. Reference numeral 19 indicates such a split area. Upper fringe of the waste portion 13 is continuous with the fabric part 11, through a front-rear joined area 15; and lower fringe of the waste portion 13 is knitting-wise formed to be continuous with next one of the fabric parts having a pattern of one unit of the article, through an area of a repeat cut line 16.

When synthetic fibers having heat contraction property such as polyester fibers or nylon fibers are used for knitting yarns; above-described warp knitting fabric usually requires heat setting process in order to achieve a dimension stability or a shape stability of the knitted article. If the heat setting were not carried out, the knitted article undergoes a large elongation/contraction at a time of washing or ironing the knitted article so that there may be caused a deviation of size of the article from the original, or an uneven contraction at portions of the article, or wrinkles as well as deforming or distorting of the article shape.

Thus, the heat set processing is needed after the knitting. However, when the warp knitting fabric knitted as shown by FIG. 12 is subjected to heat setting; then, there might be caused a deformation of tube-shaped leg portions as to contract in knitting width direction, at a time of the heat setting, as shown in FIG. 13.

The invention is to solve the above problems; and an embodiment of the invention will be explained hereafter.

BRIEF DESCRIPTION OF THE DRAWINGS

FIG. 1 shows an example of a warp knitting fabric of the invention; and fabric parts in a pattern shaped as underpants or panty are continuously formed by knitting. On course of knitting this warp knitting fabric, the fabric parts 1 in a predetermined pattern shaped as underpants or panty are formed by knitting. Simultaneously formed are waste portions 3 or marginal fabric portions that are to be ultimately cut off from the fabric parts 1, which are to become articles to be shipped. Adjacently on right-hand and left-hand fringes on each of the waste portion 3, arranged are tube-shaped leg portions on right-hand and left-hand sides, which are continuous from trunk part of the fabric parts 1. The right-hand and left-hand fringes 3*a* of the waste portion 3, which run in wale direction, are connected to neighboring fringes 4*a* running in wale direction, of the tube-shaped leg portions 4, through bridging portions 2. The bridging portions 2 are formed at a predetermined interval in wale direction and are formed by yarns passing between the fringes 3*a* of the waste portion 3 and the fringes 4*a* of the tube-shaped leg portions 4.

Figure 1:
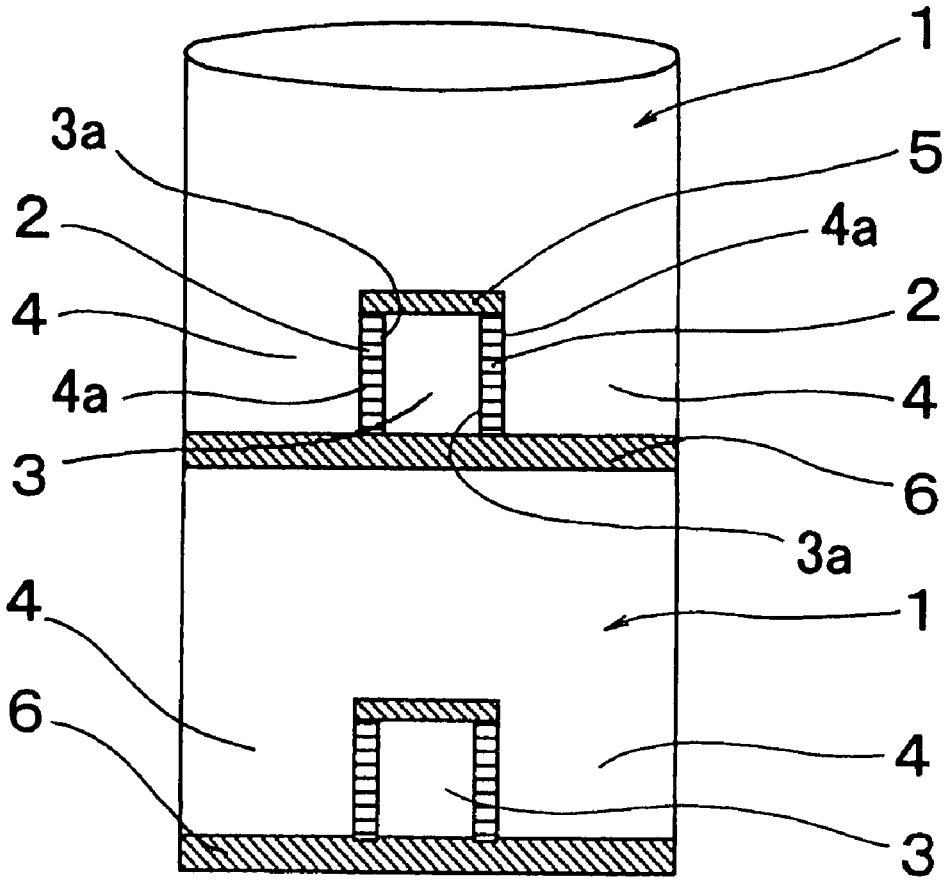
FIG. 1 is an outline view showing a warp knitting fabric on course of knitting, in a pattern of underpants or panty, according to the invention.

Knitting is made in a manner that; upper fringe of the waste portion 3 adjoins to one of the fabric parts 1, through the front-rear joined area 5, as a result of the knitting; and, lower fringe of the waste portion 3 adjoins to another one of the fabric parts 1, through an area of the repeat cut line 6 that lies between the one and another of the fabric parts. The waste portion 3 may be formed by knitting to separately form front and rear ground fabrics; and may also be formed by knitting to form a single sheet of fabric. The front-rear joined area 5 on upper fringe of the waste portion 3 is formed by knitting in a manner that yarns of front and rear ground fabrics are joined with each other; to eventually form a crotch portion requiring no sewing procedure, when the waste portion 3 is cut off and removed.

The warp knitting fabric has no free fringe at between the tube-shaped leg portions 4 and the waste portion 3. Thus, even when synthetic yarns of heat contraction property such as polyester or nylon are used for the knitting; heat setting processes or the like after the knitting gives the fabric shaped in a predetermined pattern and gives no distorted shaping. Moreover, when having been subjected to heat setting process and having been completed as an article to be shipped, no excess contraction nor distortion by way of washing or ironing is caused so that; predetermined size and shape are preserved, formation of wrinkles or slacking is curbed and touch at a time of wearing the fabric article is kept in a level.

Figure 2:
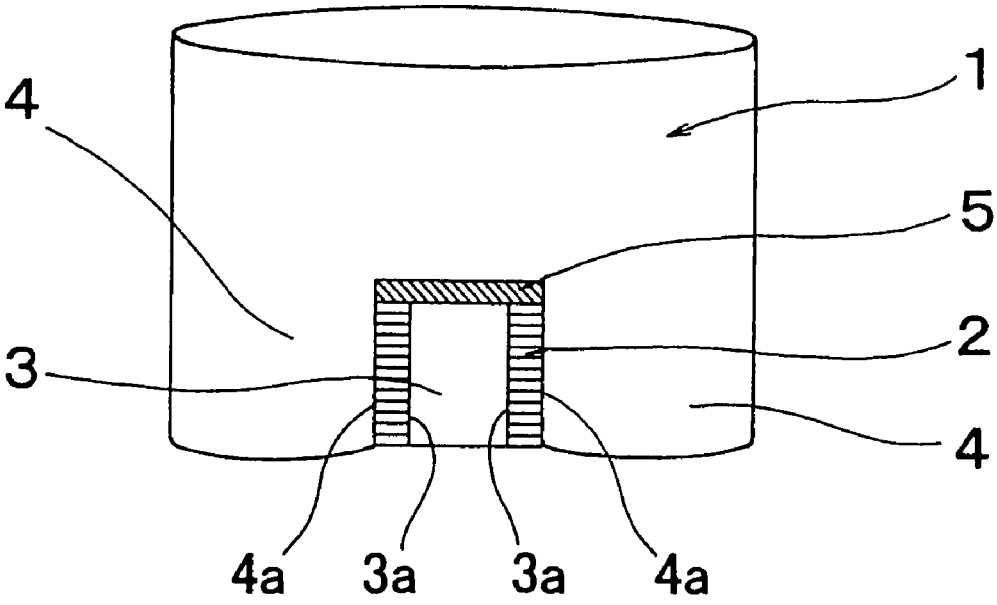
FIG. 2 is an outline view showing one cut out, by cutting at repeat cut lines, from the warp knitting fabric of FIG. 1.
Figure 3:
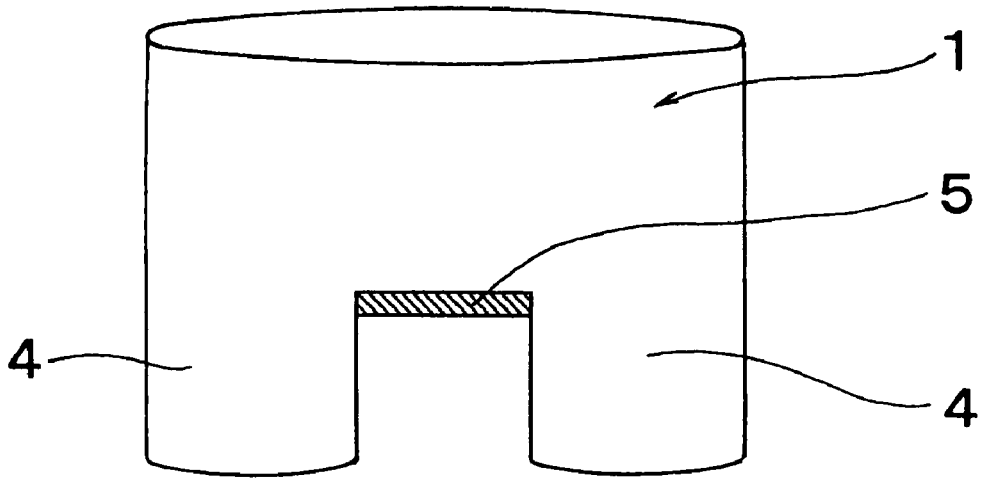
FIG. 3 is an outline view of a completed fabric article as underpants or panty, formed of the above warp knitting fabric.

FIG. 2 shows a fabric piece obtained by cutting the warp knitting fabric of FIG. 1, into ones each corresponding a pattern for one unit of the article. FIG. 3 shows one obtained by removing the waste portion 3 from the fabric piece shown in FIG. 2.

As explained hereto, according to the invention, the fabric parts 1 are formed in the predetermined pattern by the warp knitting. Fringes along the wale direction, of the fabric part 1 (for example, fringes 4*a* on inner sides of the tube-shaped leg portions 4 on right-hand and left-hand sides) are connected with fringes along the wale direction, of a marginal fabric portion (for example, fringes 3*a* of the waste portion 3) to be cut off from the fabric part 1, through bridging portions 2 that are arranged at a predetermined interval in the wale direction. Thus, the fabric parts 1 have been made to be connected with the marginal fabric portions such as the waste portions 3; and thereby, contraction after the knitting, on occasion of heat setting or the like, becomes evenly distributed within whole area of the warp knitted fabric so that; deformation of silhouette or wrinkle formation due to partial contraction within the fabric part 1 is curbed and dimensional stability is tend to be improved. Resultantly, the articles excellent in touch are produced in good yield.

When to provide the warp knitting fabric and warp knitted articles that are explained above, the bridging portions 2 are formed by knitting as follows. Yarns among the knitting yarns forming the front and rear ground fabrics of the tube-shaped fabric parts 1 for example are passed for knitting, at required portions, between; a wale on the fringes 4*a* of the tube-shaped leg portions 4 of the fabric parts 1; and a wale on the fringes 3*a* of the waste portions 3, which are marginal fabric portions adjacent to the tube-shaped leg portions; so that the fringes 4*a* and 3*a* are connected with each other. More preferably, substantially no passing of yarns between the fringes 4*a* and 3*a* is made except for the yarns forming the bridging portions 2.

Dimension of each of the bridging portion 2, in wale direction, is preferably in a range of 2 through 20 courses, more preferably in a range of 2 through 16 courses. When the dimension of the bridging portion 2 is less than 2 courses, there is a concern of deteriorating a shape and a dimension stability of the tube-shaped fabric parts 1; and when the bridging portions 2 being more than 16 courses, there is a concern of becoming difficult to be cut when the fabrics having been subjected to processing.

It is preferred that the bridging portion 2 is knitted at an interval in a range of 2 through 50 courses, further preferably, 2 through 16 courses in the wale direction. When the interval is less than 2 courses, the interval of the connecting portions by bridging is short and there is a concern that the bridging portion 2 is difficult to be cut after the fabric have been processed. Further, when the interval is wider than 50 courses, the shape and the dimension stability of the product may be deteriorated, and there is concern that the product is not finished by a predetermined shape.

Figure 10:
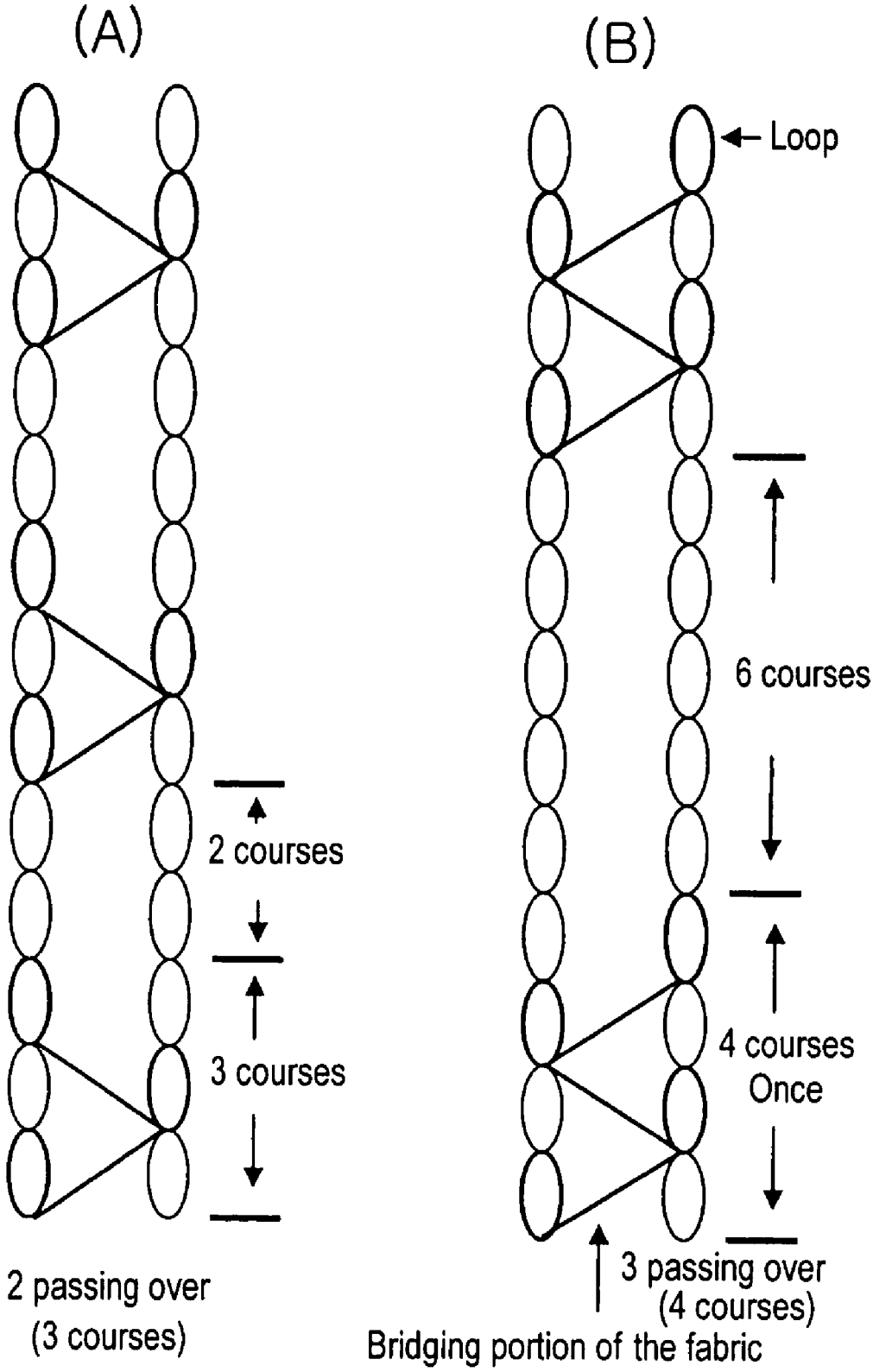
FIG. 10 illustrates conceptual views showing two examples of bridging portions in a warp knitting fabric of the invention.

FIG. 10(A) shows a case in which; the dimension in the longitudinal direction, of the each bridging portion 2 or connected portion is 3 courses; a number of the passing over of yarns for the each bridging portion 2 is two; and interval between the bridging portions 2 is 2 courses. FIG. 10(B) shows a case in which; the dimension in the longitudinal direction, of the each bridging portion 2 is 4 courses; a number of the passing over yarns for the each bridging portion 2 is three; and interval between the bridging portions 2 is 6 courses.

Figure 4:
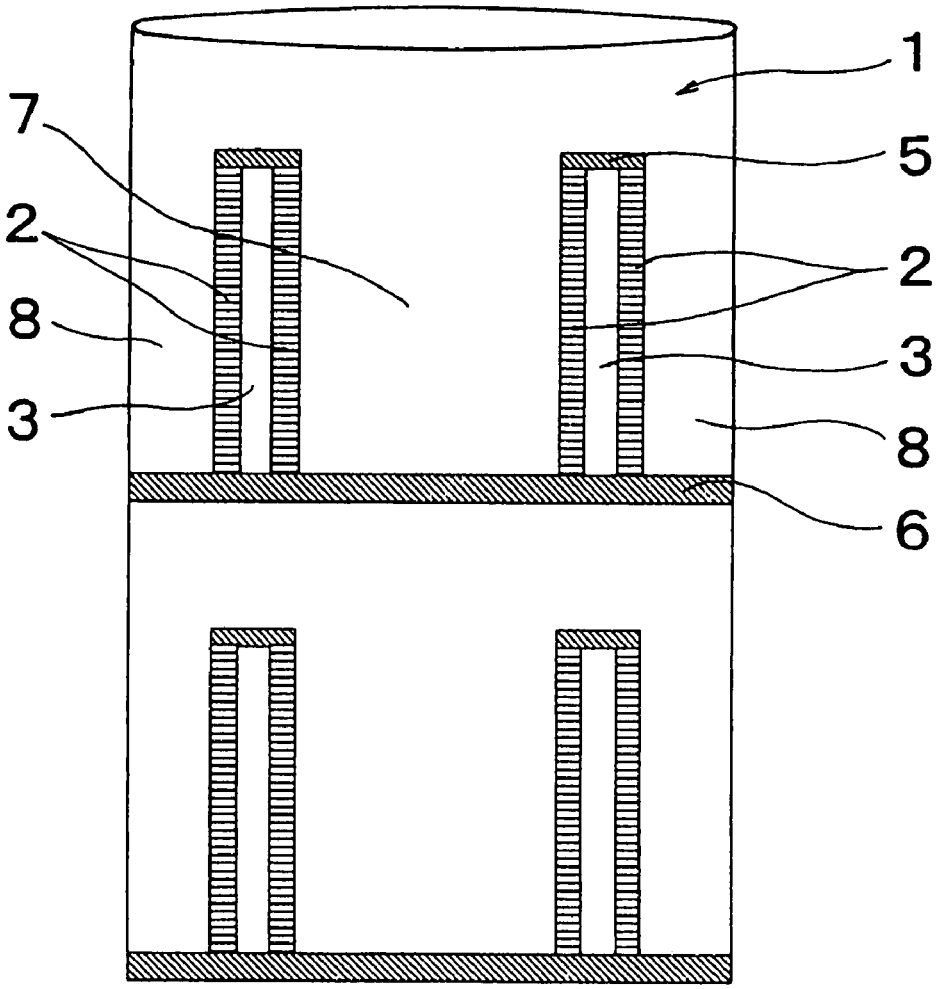
FIG. 4 is an outline view showing a warp knitting fabric on course of knitting, in a pattern of a shirt, according to the invention.

FIG. 4 shows another example of a warp knitting fabric of the invention; and fabric parts in a pattern shaped as a shirt are continuously formed by knitting. On course of knitting this warp knitting fabric, tube-shaped fabric parts 1 are formed by knitting, in a predetermined pattern shaped as a shirt. Simultaneously formed are waste portions 3 or marginal fabric portions that are slender areas to be eventually cut off from the fabric parts 1, which are to eventually become articles to be shipped. The waste portions 3 are formed in a manner to form a trunk part 7 and right-hand and left-hand sleeve portions 8, within the each fabric part 1. The right-hand and left-hand fringes running in wale direction, on each of the waste portions 3 are connected to neighboring fringes running in wale direction, of the trunk part 7 and the sleeve portion 8, through bridging portions 2. The bridging portions 2 are formed at a predetermined interval in wale direction, and are formed by knitting in a manner as explained for preceding example.

Also in this warp knitting fabric, the fabric parts 1 have been made to be connected with the marginal fabric portions such as the waste portions 3; and thereby, contraction after the knitting, on occasion of heat setting or the like, becomes evenly distributed within whole area of the warp knitted fabric so that; deformation of silhouette or wrinkle formation due to partial contraction within the fabric part 1 is curbed and dimensional stability is tend to be improved.

Figure 5:
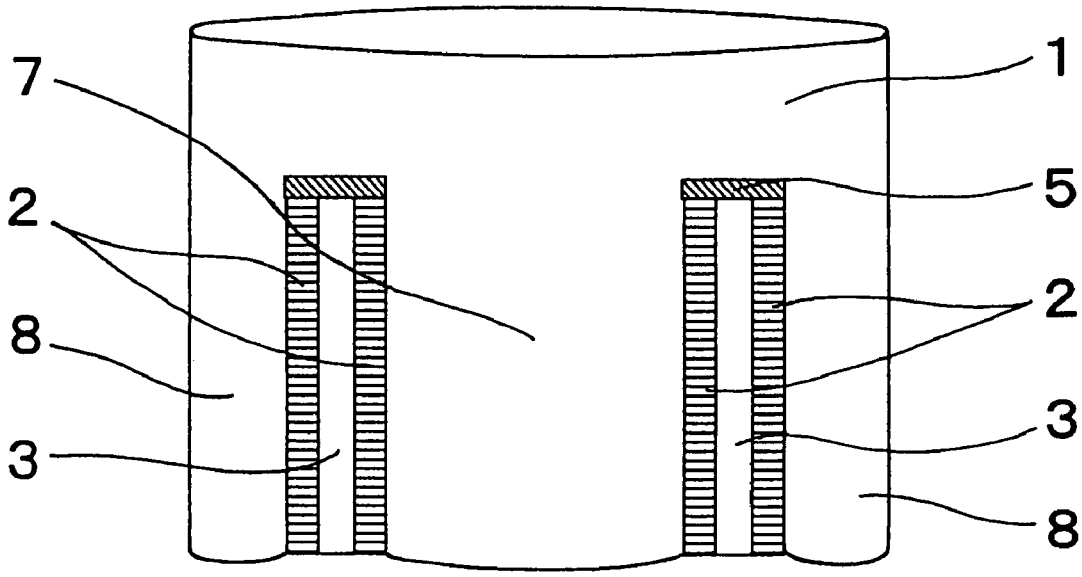
FIG. 5 is an outline view of view showing one cut out, by cutting at repeat cut lines, from the warp knitting fabric of FIG. 1 in a pattern of a shirt.
Figure 6:
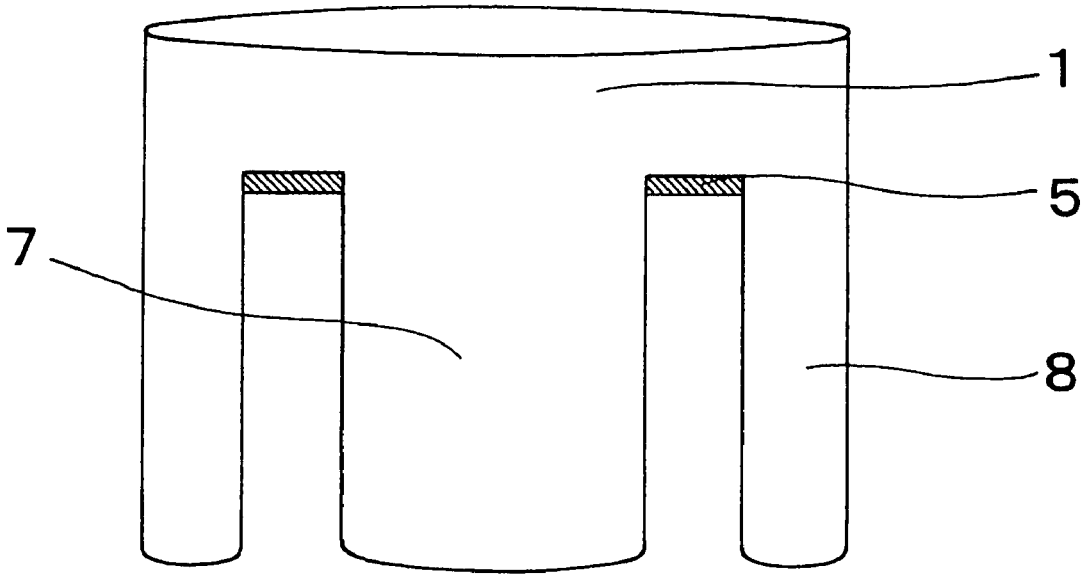
FIG. 6 is an outline view of a completed fabric article as a shirt, formed of the warp knitting fabric of FIG. 5.

FIG. 5 shows a fabric piece obtained by cutting the warp knitting fabric of FIG. 4, into ones each corresponding a pattern for one unit of the article. FIG. 6 shows one obtained by removing the waste portion 3 from the fabric piece shown in FIG. 5.

Figure 7:
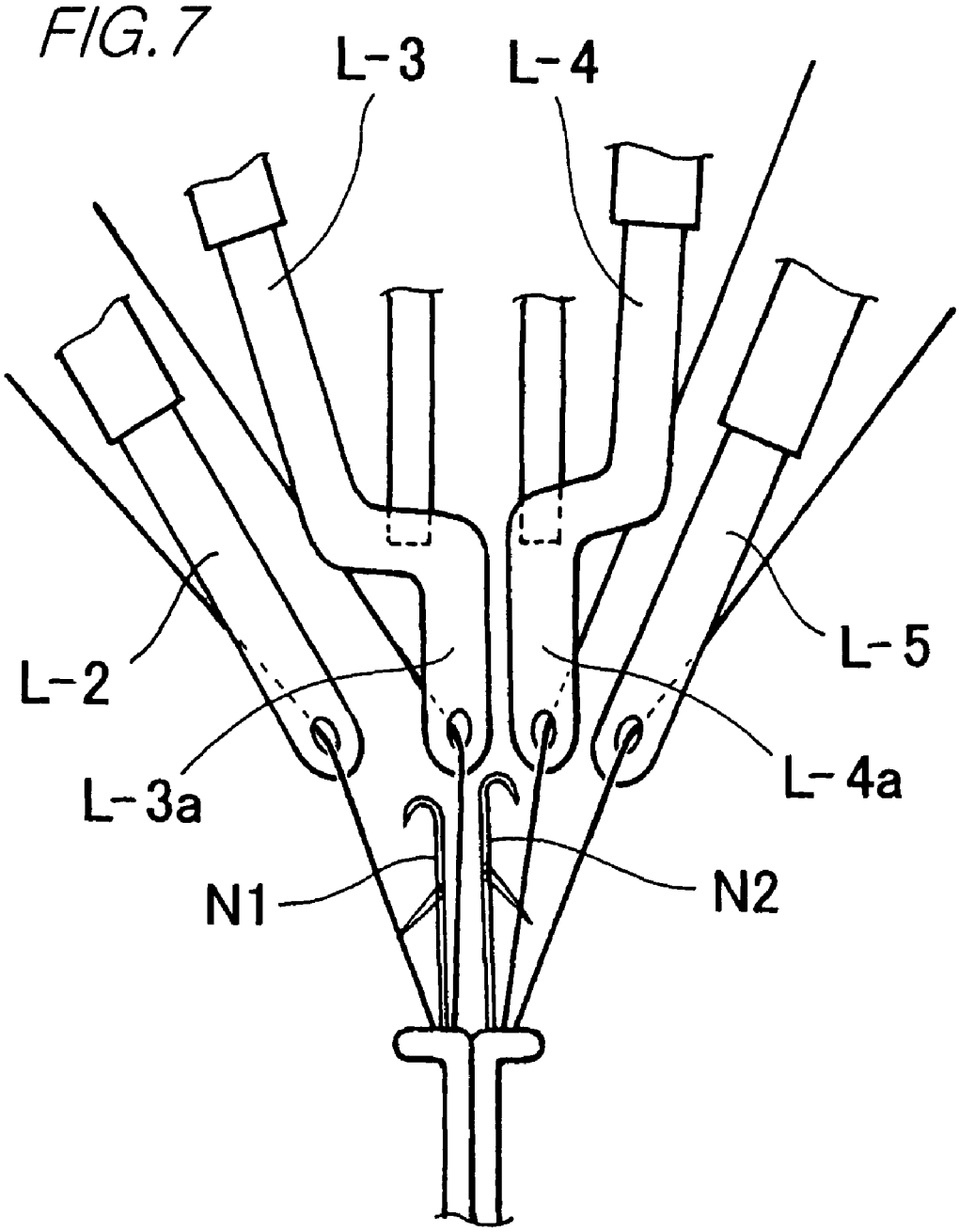
FIG. 7 is an outline view of an essential portion of a double Rachel machine.

The here-to-explained warp knitting fabrics of the invention may be knitted by a double Rachel knitting machine, particularly, a double Rachel knitting machine having a jacquard reed exemplified in FIG. 7. In FIG. 7, notations N1 and N2 designate front and rear knitting needles and numbers thereof are aligned in a direction orthogonal to paper face of the drawing. Notations L-2, L-3, L-4 and L-5 respectively designate reeds each for guiding knitting yarns; among them, the reeds L-3 and L-4 are jacquard reeds, movements of which are controlled by jacquard mechanism. Guides L-3*a* and L-4*a* for guiding yarns are provided as to be able to be displaced in a transverse direction by a distance of one stitch, separately from the movements of the reeds. And, displacements of the guides L-3*a* and L-4*a* are controlled by the jacquard mechanism.

Figure 8:
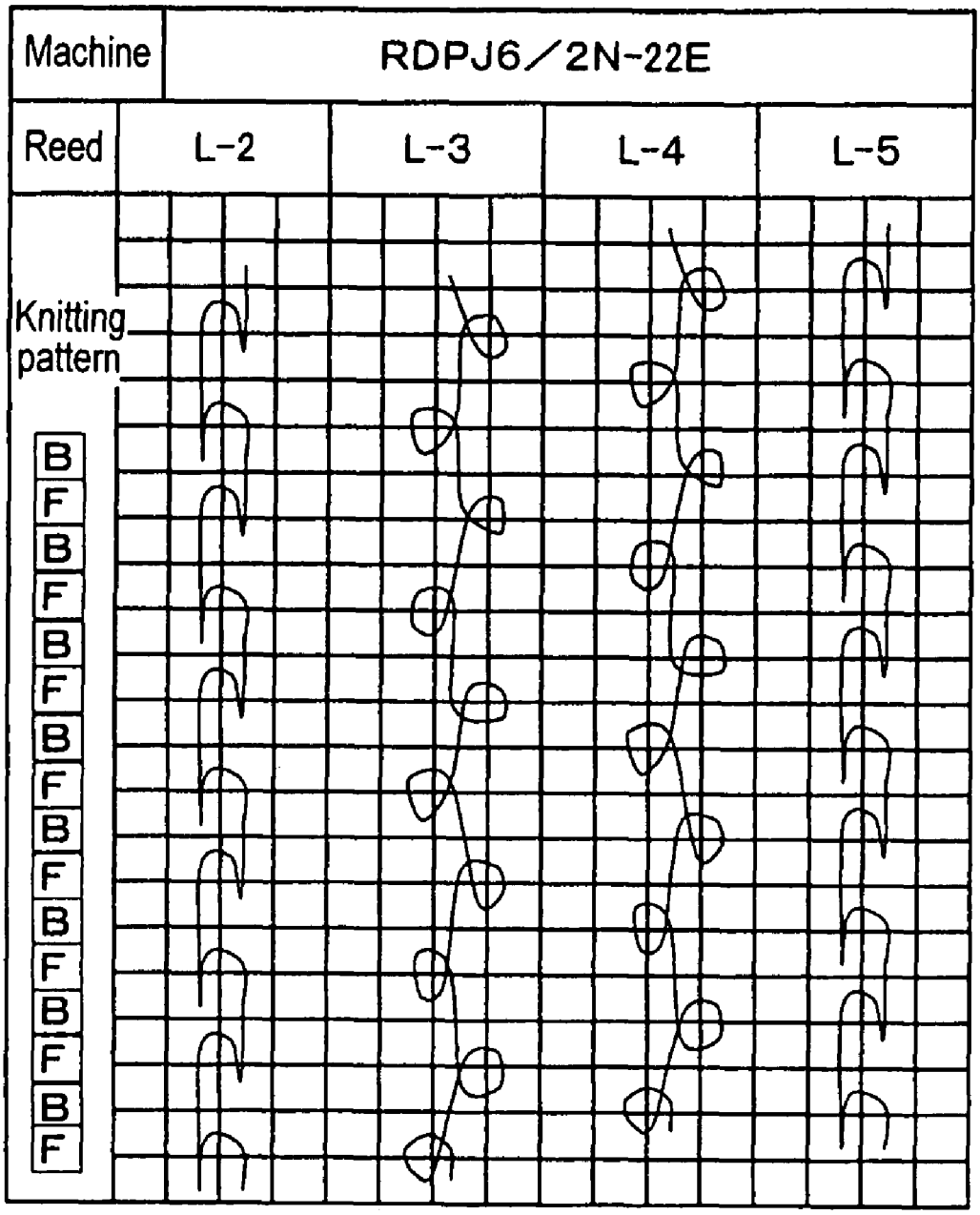
FIG. 8 is a diagram showing an example of knitting pattern for ground fabric parts, in a warp knitting fabric of the invention.
Figure 9:
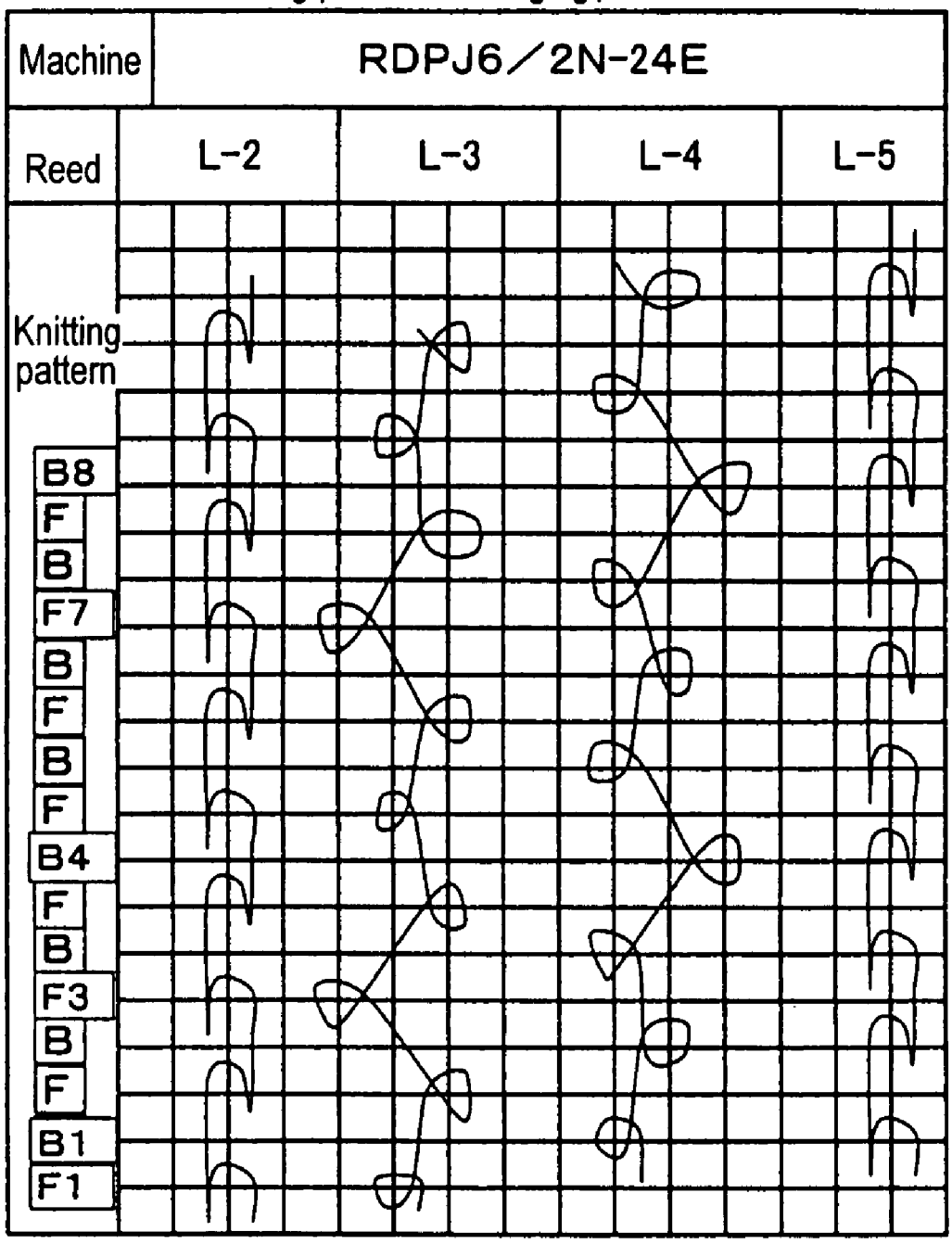
FIG. 9 is a diagram showing an example of knitting pattern for bridging portions, in a warp knitting fabric of the invention.

FIG. 8 shows an example of a knitting pattern for the fabric parts 1 according to the invention; and FIG. 9 shows an example of a knitting pattern for the bridging portion 2 according to the invention.

In the knitting diagrams of FIGS. 8 and 9, notation "F" designates a knitting course by a front side knitting needle; notation "B" designates a knitting course by a rear side knitting needle. In the course of "F", the front ground fabric is knitted by knitting yarns of the reeds L-2 and L-3; and in the course of "B", the rear ground fabric is knitted by knitting yarns of the reeds L-5 and L-4. The tube-shaped fabric parts are formed by joining the front and rear ground fabrics at their right-hand and left-hand sides fringes by a method of seam knitting or the like (not illustrated).

As exemplified in the knitting pattern of FIG. 9, the bridging portion 2 according to the invention is a portion of the front and rear ground fabrics. The front and rear ground fabrics are formed by knitting with yarns guided by the reeds (jacquard reeds) L-3 and L-4 and yarns guided by the reeds L-2 and L-5. Simultaneously, fringes of the front and rear ground fabrics in respect of the each fabric part are joined as follows. A yarn for a wale on fringe of the fabric part 1 (fringe of the pattern) and/or the marginal fabric portion, among the yarns guided by the reeds L-3 and L-4, is displaced in course direction excessively by a distance of one stitch under action of jacquard mechanism as to be passed into an adjoining wale on fringe of the marginal fabric portion and/or the fabric part, at courses arranged in a predetermined interval in longitudinal direction.

The above knitting pattern means following. Yarns on the reed L-3 are used to form the front ground fabric in knitting a course of "F3". Simultaneously, yarns for fringes of the fabric part or the pattern are further displaced to reach a position of adjacent knitting needle, as to make an underlapping. Thus, the bridging portions that connect a wale on fringe of the fabric part and a wale of fringe of the marginal fabric portion are formed at sinker loops of the underlapping. Same way of knitting is made also in knitting a course of "F7".

The above knitting pattern also means following. Yarns on the jacquard reed L-4 are used to form the rear ground fabric, in knitting at a course of "B4". Simultaneously, yarns for fringes of the pattern are further displaced to reach a position of adjacent knitting needle, as to make an underlapping. Thus, the bridging portions that connect a wale on fringe of the fabric part and a wale of fringe of the marginal fabric portion are formed at sinker loops of the underlapping. Same way of knitting is made also in knitting a course of "B7".

By the above-described knitting, the fringes along the wale direction, of the fabric part and the marginal fabric portion, are connected only at the bridging portions 2 that are the sinker loop portions of yarns of the reeds L-3 and L-4. Thus, cutting and separation after processing is facilitated.

In this way, a fringe of the pattern of the fabric part 1 and a neighboring fringe of the marginal fabric portion are connected, on course of knitting to form the pattern of the fabric part 1 and the marginal fabric portions such as the waste portion 3 by knitting in wale direction. Resultantly, whole area of the warp knitting fabric is continuous; and when subjected to a heat treatment, effect of the treatment is uniform on the whole area. Thus, the fabric articles are finished by a predetermined shape and dimensions.

The bridging portions 2 are formed by a predetermined dimension and by a predetermined interval in the longitudinal or wale direction as to connect the fabric part and the marginal fabric portion. Thus, cutting for the removing after the processing is facilitated; and quality of the knitting fabric in the pattern would be rarely deteriorated.

Preferably, the fabric parts 1 are successively formed at a constant interval that corresponds dimension in wale direction, of one unit of the article. By such a manner, loss of the fabric at a time of cutting off is reduced.

Figure 11:
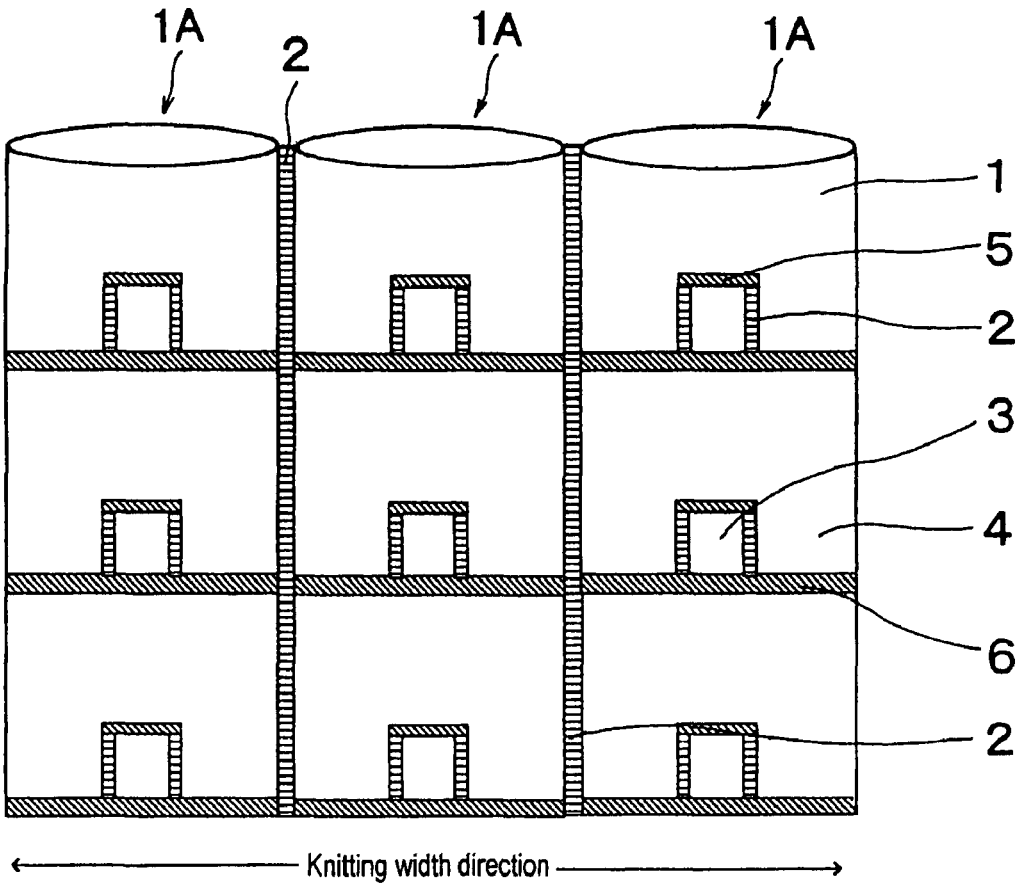
FIG. 11 is an outline view of knitting a plurality of patterns in a width direction of a warp knitting fabric of the invention.

It is preferred to knit as shown in FIG. 11. A plurality of long fabrics 1A extending in wale direction, on each of which the fabric parts 1 are formed are formed to be continuous in the wale direction, are connected by knitting together, in a side-by-side arrangement in a course direction. From each of the knitting fabrics 1A, adjacent ones of the knitting fabrics 1A are cut off after the knitting, as the marginal fabric portions. Thus, connecting between the knitting fabrics 1A may be made by the bridging portions 2 that are formed by passing a portion of number of the yarns to and from fringes of the long fabrics 1A, and are formed at an interval in wale direction.

The above way of knitting may be adopted not only for a pattern of underpants or panty or a pattern of shirts, which are shown in the drawings, but also for other clothing articles, for sheet covers or other sack shaped articles and for other various articles of warp knitting fabrics. Thus the usage is not particularly limited.

In the invention, the pattern refers to a contour of a shirt, underpants or a panty, a skirt or other clothing, or to contour of a pouch, a bag or the like. For example, the pattern is a contour of end-use article produced by a warp knitting machine having jacquard mechanism, for example, by the double Rachel knitting machine.

The bridging portions connect the fringe along the wale direction, of the fabric parts in the pattern to a neighboring fringe along the wale direction, of the marginal fabric portion. The bridging portions take a role for making a stress incurred at a time of thermal contraction become uniform over whole area of the warp knitted fabric.

EXAMPLES

Example 1

A double Rachel knitting machine (made by KARL MAYER RDPJ6/2N-24E) having jacquard reeds was used. Based on the knitting patterns of FIGS. 8 and 9, polyester yarns of 67dtex50f were used for the reeds L-2 and L-5; and, for the jacquard reeds L-3 and L-4, covered yarns were used which are formed by single covering at a covering number of 500 T/m from polyester yarns of 44dtex34f and polyurethane elastic yarns of 44dtex. As shown in FIGS. 1 and 2, a warp knitting fabric in a pattern of underpants or panty was formed by the knitting. Knitting densities of the fabric just after the knitting were 56 courses and 38 wales per inch. Bridging portions that connect the article-forming fabric part and the to-be-discarded marginal fabric portion were formed as follows; sinker loops are spanned between wales to form the bridging portions at an interval of 3 courses in wale direction; and dimension of each of the bridging portions in wale direction is 3 courses or two sinker loops.

Thus obtained knitting fabric is scoured at 60° C. and subjected to heat setting (180° C.) with tentering in width direction, as to give the underpants or panty, knitting densities of which are 60 courses/inch and 40 wales/inch. Table 1 shows knitting densities and dimensions as well as evaluation results.

Example 2

The double Rachel knitting machine having the jacquard reed (made by KARL MAYER RDPJ6/2N-24E) was used. Based on the knitting patterns of FIGS. 8 and 9, polyester yarns of 67dtex50f were used for the reeds of L-2 and L-5; and, for the jacquard reeds L-3 and L-4, covered yarns were used which are formed by single covering at a covering number of 500 T/m from polyester yarns of 44dtex34f and polyurethane elastic yarns of 44dtex. As shown in FIGS. 1 and 2, a warp knitting fabric in a pattern of underpants or panty was formed by the knitting. Knitting densities of the fabric just after the knitting were 50 courses and 34 wales per inch. Bridging portions that connect the article-forming fabric part and the to-be-discarded marginal fabric portion were formed as follows; sinker loops are spanned between wales to form the bridging portions at an interval of 20 courses in wale direction; and dimension of each of the bridging portions in wale direction was 5 courses or 4 sinker loops.

Thus obtained knitting fabric is scoured at 60° C. and subjected to heat setting (180° C.) with tentering in width direction, as to give the underpants or panty, knitting densities of which are 60 courses/inch and 40 wales/inch. Table 1 shows knitting densities and dimensions as well as evaluation results.

Example 3

The double Rachel knitting machine having the jacquard mechanism (made by KARL MAYER RDPJ6/2N-24E) was used. Based on the knitting patterns of FIGS. 8 and 9, polyester yarns of 67dtex50f were used for the reeds of L-2 and L-5; and, for the jacquard reeds L-3 and L-4, covered yarns were used which are formed by single covering at a covering number of 500 T/m from polyester yarns of 78dtex36f and polyurethane elastic yarns of 44dtex. As shown in FIGS. 4 and 5, a warp knitting fabric in a pattern of a shirt was formed by the knitting. Knitting densities of the fabric just after the knitting were 48 courses and 36 wales per inch. Bridging portions that connect the article-forming fabric part and the to-be-discarded marginal fabric portions disposed at inside of the sleeves were formed as follows; sinker loops are spanned in the course direction between wales to form the bridging portions at an interval of 40 courses; and dimension of each of the bridging portions in the longitudinal direction was 7 courses or 6 sinker loops.

Thus obtained knitting fabric is scoured at 60° C. and subjected to heat setting (180° C.) with tentering in width direction, as to give the shirt, knitting densities of which are 60 courses/inch and 40 wales/inch. Table 1 shows knitting densities and dimensions as well as evaluation results.

Comparative Example 1

Figure 12:
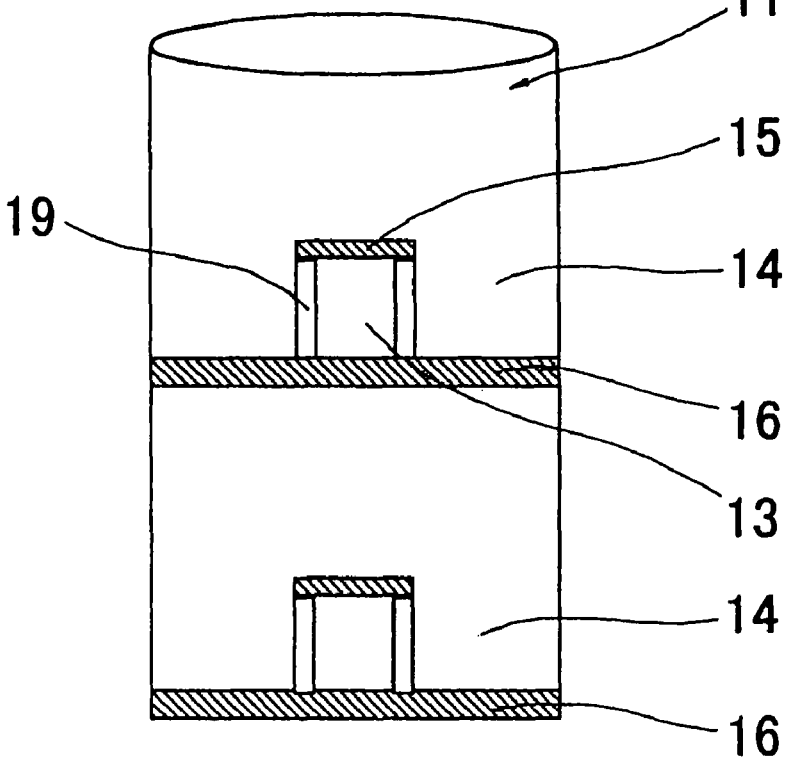
FIG. 12 is an outline view showing a conventional warp knitting fabric on course of knitting, in a pattern of underpants or panty.
Figure 13:
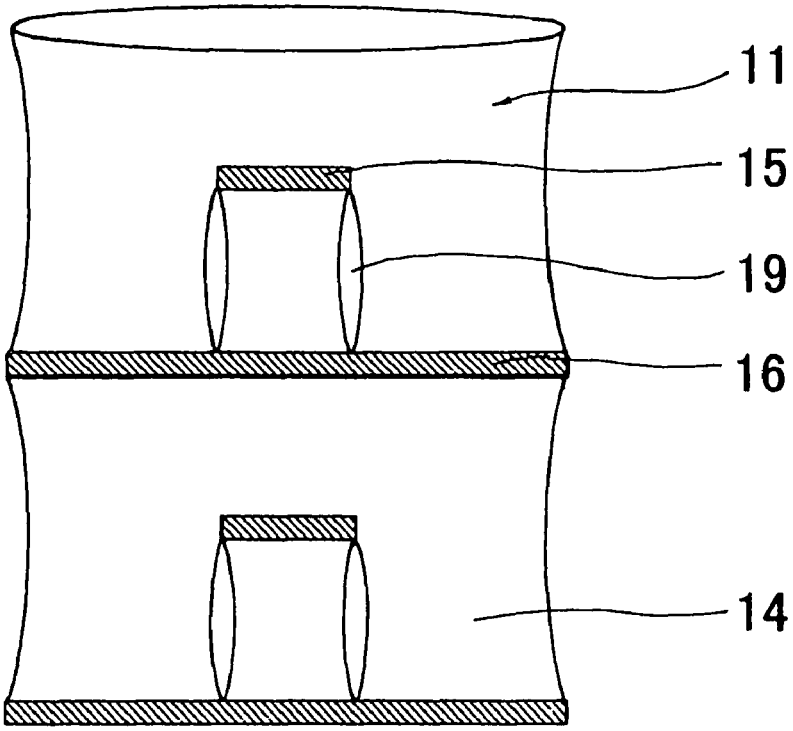
FIG. 13 is an outline view showing the conventional warp knitting fabric that has been subjected to heat setting and shows a contraction.

The double Rachel knitting machine having the jacquard mechanism (made by KARL MAYER RDPJ6/2N-24E) was used. Based on the knitting pattern of FIG. 8, polyester yarns of 67dtex50f were used for the reeds L-2, L-5; and, for the jacquard reeds L-3 and L-4, covered yarns were used which are formed by single covering at a covering number of 500 T/m from polyester yarns of 44dtex34f and polyurethane elastic yarns of 33dtex. As shown in FIG. 12, a warp knitting fabric in a pattern of underpants or panty was formed by the knitting. Knitting densities of the fabric just after the knitting were 56 courses and 38 wales per inch. The each waste portion that comes under the crotch is not connected to right-hand-side and left-hand-side neighboring portions and is continuous to the article-forming fabric parts only through upper and lower fringe of the waste portion.

Thus obtained knitting fabric is scoured at 60° C. and subjected to heat setting (180° C.) with tentering in width direction, as to give the underpants or panty, knitting densities of which are 70 courses/inch and 52 wales/inch. Table 1 shows knitting densities and dimensions as well as evaluation results.

Comparative Example 2

The double Rachel knitting machine having the jacquard mechanism (made by KARL MAYER RDPJ6/2N-24E) was used. Based on the knitting patterns of FIGS. 8 and 9, polyester yarns of 67dtex50f is used for the reeds L-2 and L-5; and, for the jacquard reeds L-3 and L-4, covered yarns were used which are formed by single covering at a covering number of 500 T/m from polyester yarns of 44dtex34f and polyurethane elastic yarns of 44dtex. As shown in FIGS. 4 and 5, a warp knitting fabric in a pattern of a shirt was formed by the knitting. Knitting densities of the fabric just after the knitting were 48 courses and 36 wales per inch. Bridging portions that connect the article-forming fabric part and the to-be-discarded marginal fabric portion were formed as follows; sinker loops are spanned between wales to form the bridging portions, at all courses, without an interval in the longitudinal or wale direction.

Thus obtained knitting fabric is scoured at 60° C. and subjected to heat setting (180° C.) with tentering in width direction, as to give the shirt, knitting densities of which are 60 courses/inch and 40 wales/inch. Table 1 shows knitting densities and dimensions as well as evaluation results.

Comparative Example 3

The double Rachel knitting machine having the jacquard mechanism (made by KARL MAYER RDPJ6/2N-24E) was used. Based on the knitting patterns of FIGS. 8 and 9, polyester yarns of 67dtex50f were used for the reeds of L-2 and L-5; and, for the jacquard reeds L-3 and L-4, covered yarns were used which are formed by single covering at a covering number of 500 T/m from polyester yarns of 44dtex34f and polyurethane elastic yarns of 44dtex. As shown in FIGS. 4 and 5, a warp knitting fabric in a pattern of a shirt was formed by the knitting. Knitting densities of the fabric just after the knitting were 50 courses and 34 wales per inch. Bridging portions that connect the tube-shaped article-forming fabric part and the to-be-discarded marginal fabric portions positioned at inside of the sleeves were formed as follows; sinker loops are spanned between wales to form the bridging portions at an interval of 60 courses in wale direction; and dimension of each of the bridging portions in wale direction was 11 courses or 10 sinker loops.

Thus obtained knitting fabric is scoured at 60° C. and subjected to heat setting (180° C.) with tentering in width direction, as to give the shirt, knitting densities of which are 60 courses/inch and 40 wales/inch. Table 1 shows knitting densities and dimensions as well as evaluation results.

The invention claimed is:

1. A warp knitting fabric having a wale direction comprising: fabric parts that form articles in a predetermined pattern; marginal fabric portions adjacent to said fabric parts that are knitted simultaneously with said fabric parts and which are eventually cut from the fabric parts; bridging portions formed by knitting at a predetermined interval in the wale direction, the bridging portions connecting a wale at a fringe of said fabric parts and a wale at a fringe of said marginal fabric portions which are adjacent to each other; and wherein the bridging portions are formed by yarns bridging only said wales which are adjacent to each other and by knitting to have a dimension in a range of 2 through 20 courses in the wale direction, at an interval in a range of 2 through 50 courses.

2. The warp knitting fabric according to claim 1, wherein said fabric parts are knitted to be continuous in the wale direction.

3. The warp knitting fabric according to claim 2, wherein a plurality of said fabric parts are knitted together in a continuous arrangement that forms a long fabric extending in the wale direction, said fabric parts further being knitted together, in a side-by-side arrangement extending in a course direction.

4. The warp knitting fabric according to any one of claims 1 through 3, being tube-shaped.

5. A manufacturing method of a warp knitting fabric having a wale direction comprising: knitting fabric parts that form articles in a predetermined pattern; knitting marginal fabric portions adjacent to said fabric parts, which marginal fabric portions are eventually cut from said fabric parts, the knitting of said marginal fabric portions being simultaneous with the knitting of said fabric parts; knitting of bridging portions at a predetermined interval in the wale direction, each of which connects a wale at a fringe of said fabric parts and a wale at a fringe of said marginal fabric portions which are adjacent to each other; and wherein the bridging portions are formed by yarns bridging only said wales which are adjacent to each

TABLE 1

| | | Example 1 | Example 2 | Example 3 | Comparative Example 1 | Comparative Example 2 | Comparative Example 3 |
|---|---|---|---|---|---|---|---|
| Bridging portions | Present or not | Present | Present | Present | None | Present | Present |
| | dimension | 3 courses | 5 courses | 7 courses | None | All courses | 11 courses |
| | Interval | 3 courses | 20 courses | 40 courses | None | None | 60 course |
| Fabric just after the knitting | Knitting densities (course/wale) | 56/38 | 56/38 | 48/36 | 56/38 | 48/36 | 48/36 |
| | Overall width (cm) | 201 | 201 | 211 | 201 | 211 | 211 |
| | Width of each tube-shaped part (cm) | 33.0 | 33.0 | 52.0 | 33.5 | 52.0 | 52.0 |
| Finished fabric | Knitting densities (course/wale) | 60/40 | 60/40 | 60/40 | 70/52 | 60/40 | 60/40 |
| | Overall width (cm) | 190 | 190 | 190 | 148 | 190 | 190 |
| | Width of each tube-shaped part (cm) | 31.0 | 31.0 | 47.0 | 24.5 | 47.0 | 47.0 |
| Evaluation | Easiness of cutting the bridging portions | ▯ (good) | ▯ | ▯ | — | ▯ | ▮ (poor) |
| | Yield of dimension for finished fabric (%) | 95 | 95 | 98 | 55 | 65 | 95 |
| | Deformation of finished fabric | ▯ | ▯ | Δ(moderate) | ▯ | ▯ | ▮ |
| | Touch | ▯ | ▯ | ▯ | ▮ | ▯ | ▯ |
| | Overall rating | ▯ | ▯ | ⊙(excellent) | ▮ | ▮ | ▮ |

other and by knitting to have a dimension in a range of 2 through 20 courses in the wale direction, at an interval in a range of 2 through 50 courses.

6. The manufacturing method of a warp knitting fabric according to claim 5, wherein a portion of number of yarns of said fabric part are passed between a fringe of said fabric parts and a fringe of said marginal fabric portions during knitting of the bridging portions.

* * * * *